US006658126B1

(12) United States Patent
Stern

(10) Patent No.: US 6,658,126 B1
(45) Date of Patent: Dec. 2, 2003

(54) HEARING AID COMPATIBLE PIEZOELECTRIC SPEAKER

(75) Inventor: Trampas B. Stern, Raleigh, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/287,242

(22) Filed: Apr. 7, 1999

(51) Int. Cl.[7] ..... H04R 25/00

(52) U.S. Cl. ..... 381/331; 381/173; 381/190; 379/52

(58) Field of Search ..... 381/173, 182, 381/190, 331; 310/311; 379/52, 430

(56) References Cited

U.S. PATENT DOCUMENTS

| | | | | |
|---|---|---|---|---|
| 4,712,247 A | * | 12/1987 | Swarte | 381/96 |
| 4,916,821 A | * | 4/1990 | Potter | 33/362 |
| 5,195,142 A | * | 3/1993 | D'Avolio et al. | 381/173 |
| 5,245,669 A | * | 9/1993 | Bittencourt | 381/184 |
| 5,624,376 A | * | 4/1997 | Ball et al. | 600/25 |
| 6,137,889 A | * | 10/2000 | Shennib et al. | 381/328 |
| 6,321,070 B1 | * | 11/2001 | Clark et al. | 455/90 |

FOREIGN PATENT DOCUMENTS

| | | |
|---|---|---|
| EP | 0169792 | 1/1986 |
| JP | 57065092 | 4/1982 |
| JP | 62071480 | 4/1987 |
| JP | 07240995 | 9/1995 |

OTHER PUBLICATIONS

International Search Report, PCT/US00/03684, mailed Oct. 27, 2000.

* cited by examiner

*Primary Examiner*—Huyen Le
*Assistant Examiner*—Tuân Dũc Nguyêñ
(74) *Attorney, Agent, or Firm*—Myers Bigel Sibley & Sajovec, P.A.

(57) ABSTRACT

A piezoelectric speaker is provided which provides a magnetic field to couple the speaker to a hearing aid coil. The magnetic field induces a current in the hearing aid coil as it appears as a time varying magnet field to the coil. The time varying magnetic field is preferably proportional to the movement of a piezoelectric member of the piezoelectric speaker so as to induce a current in the hearing aid coil proportional to this movement. Such a magnetic field may be provided by connecting a magnetic material to the piezoelectric speaker such that motion in the speaker results in motion of the magnetic material, preferably at the position of maximum displacement of the speaker. Thus, the piezoelectric speaker may provide hearing aid compatibility.

6 Claims, 3 Drawing Sheets

HEARING AID COMPATIBLE PIEZOELECTRIC SPEAKER

FIELD OF THE INVENTION

The present invention relates generally to piezoelectric speakers and more particularly to piezoelectric speakers suitable for use in radiotelephones.

BACKGROUND OF THE INVENTION

Radiotelephones which are hearing aid compatible conventionally rely on leakage from the magnetic field which drives a conventional speaker to provide hearing aid compatibility. Such compatibility is provided by a coil in the hearing aid which is coupled to the leakage field such that the time varying magnetic field of the leakage field induces a current in the coil. Thus, the hearing aid may be provided with the audio from the speaker without requiring amplification of the background noise, such a road noise, or the like.

Recently, however, radiotelephones have been produced utilizing piezoelectric speakers. Piezoelectric speakers are desirable because of their small size and low power consumption. A piezoelectric speaker utilizes one or more piezoelectric elements to drive the speaker. Piezoelectric elements operate such that the element moves in response to a voltage being applied to the element. However, the piezoelectric speaker does not produce significant magnetic fields. Accordingly, piezoelectric speakers are typically not hearing aid compatible as there is not a suitable time varying magnetic field which may induce a current in the hearing aid coil. Thus, radiotelephones utilizing piezoelectric speakers are typically not hearing aid compatible.

In light of the above discussion, a need exists for improved piezoelectric speakers.

SUMMARY OF THE INVENTION

One object of the present invention is to provide a piezoelectric speaker suitable for use in a radiotelephone.

A further object of the present invention is to provide a piezoelectric speaker which is compatible with hearing aids.

These and other objects of the present invention are provided by a piezoelectric speaker which provides a magnetic field to couple to a hearing aid coil. The magnetic field induces a current in the hearing aid coil as it appears as a time varying magnetic field to the coil. The time varying magnetic field is preferably proportional to the movement of a piezoelectric member of the piezoelectric speaker so as to induce a current in the hearing aid coil proportional to this movement. Thus, the piezoelectric speaker may provide hearing aid compatibility.

In a particular embodiment of the present invention, a piezoelectric speaker is provided in which a portion of the piezoelectric speaker moves in response to the application of electrical energy to the piezoelectric speaker. A means is provided for generating a time varying magnetic field responsive to movement of the moving portion of the piezoelectric speaker such that a time varying magnetic field is generated when the moving portion of the piezoelectric speaker moves. The means for generating a time varying magnetic field may be a magnetic element coupled to the moving portion of the piezoelectric speaker so as to move responsive to movement of the moving portion of the piezoelectric speaker. In one embodiment, the moving portion of the piezoelectric speaker is a diaphragm and the magnetic element is a magnetic film applied to the moving portion of the piezoelectric speaker. The magnetic element may be made from a magnetic material such as NdFeB.

In another embodiment of the present invention, the magnetic element is coupled to a maximum displacement location of the moving portion of the piezoelectric speaker. The hearing aid compatible acoustic device may be used as a speaker in a radiotelephone.

In a further aspect of the present invention, a method is provided for a hearing aid compatible piezoelectric speaker including generating a time varying magnetic field responsive to motion of the piezoelectric speaker. In one embodiment of the method aspects of the present invention, the generating step includes connecting a magnetic material to the piezoelectric speaker such that motion of the piezoelectric speaker results in motion of the magnetic material.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As will be appreciated by those of skill in the art, the present invention may be embodied as methods or devices.

Figure 1:
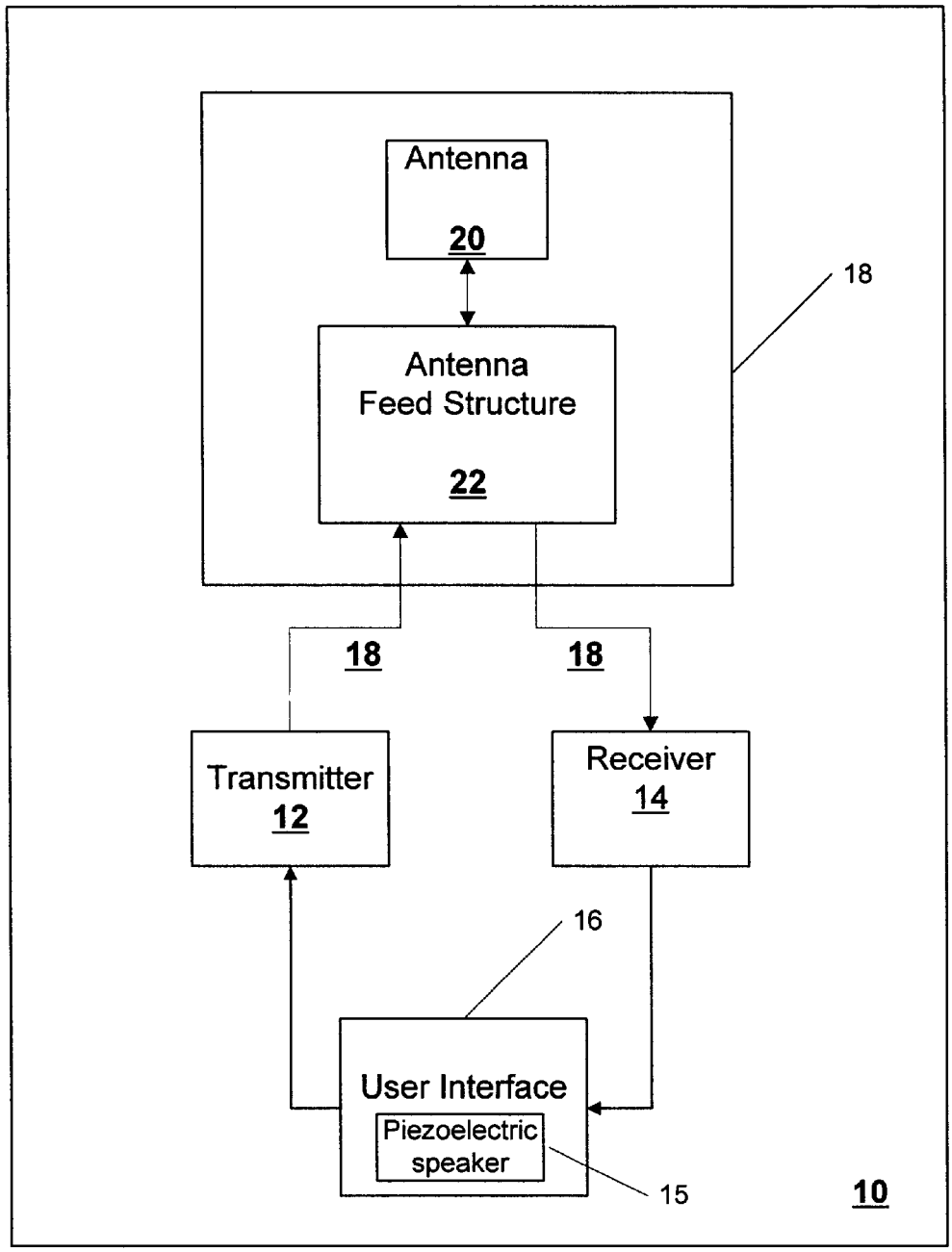
FIG. 1 is a block diagram of a radiotelephone utilizing a piezoelectric speaker according to the present invention.

An embodiment of a radiotelephone 10 which includes a piezoelectric speaker 15 according to the present invention is depicted in the block diagram of FIG. 1. As shown in FIG. 1, radiotelephone 10 typically includes a transmitter 12, a receiver 14, a user interface 16 and an antenna system 18. The antenna system 18 may include an antenna feed structure 22 and an antenna 20. As is well known to those of skill in the art, transmitter 12 converts the information which is to be transmitted by radiotelephone 10 into an electromagnetic signal suitable for radio communications.

Receiver 14 demodulates electromagnetic signals which are received by radiotelephone 10 so as to provide the information contained in the signals to user interface 16 in a format which may be made understandable to the user. In particular, the user interface 16 includes a piezoelectric speaker 15 according to the present invention for transforming the received signal into an audio signal to be heard by a user.

A wide variety of transmitters 12, receivers 14, user interfaces 16 (e.g., microphones, keypads, rotary dials) which are suitable for use with handheld radiotelephones are known to those of skill in the art, and such devices may be implemented in radiotelephone 10. The design of these aspects of radiotelephone 10 are well known to those of skill in the art and will not be further described herein.

Figure 2:
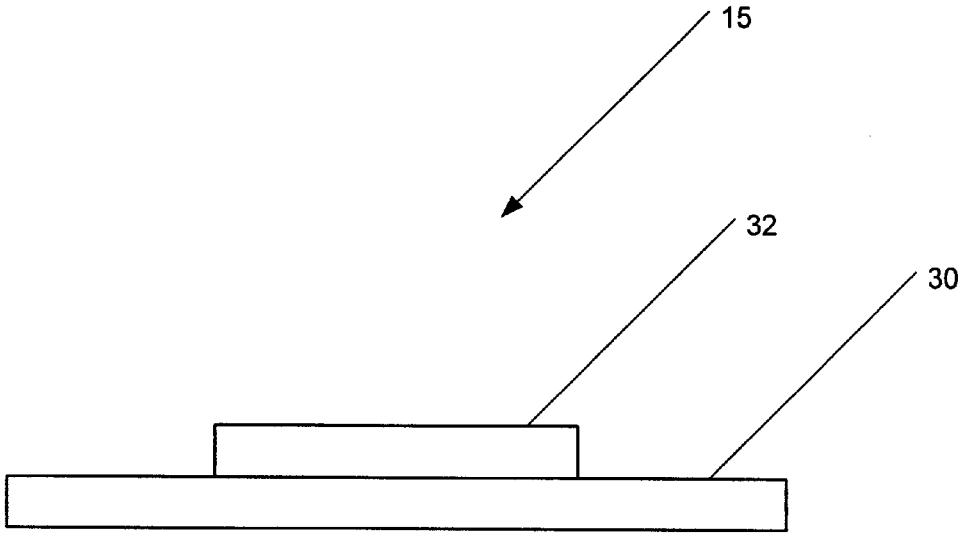
FIG. 2 is a schematic representation of a piezoelectric speaker according to one embodiment of the present invention.

FIG. 2 depicts a piezoelectric speaker 15 according to an embodiment of the present invention. As seen in FIG. 2, a piezoelectric material 30 has associated with the material a magnetic material 32. The magnetic material 32 may be a magnetic film and may be attached to the piezoelectric element or a diaphragm or cone of a piezoelectric speaker. The piezoelectric material should be attached to the piezoelectric speaker 15 in such a manner such that motion of the speaker causes motion of the magnetic material 32. Thus, for a given point in space, motion of the magnetic material generates a time varying magnetic flux.

The present invention may be utilized with any number of known piezoelectric speakers. Suitable piezoelectric speakers which may be modified to be utilized according to the present invention are known to those of skill in the art and, therefore, will not be described in detail herein. Any piezoelectric speaker which allows for inclusion of a magnetic material which may move in proportion to the audio sounds generated by the piezoelectric speaker may be utilized. Such motion may result from connection to the speaker or the diaphragm either acoustically or physically. However, preferably, the magnetic material is positioned at the point of maximum displacement of the speaker such that the magnetic material moves through the largest range of motion. Thus, the magnetic material motion may generate the maximum differential flux for a given point in space.

Materials which are suitable for use with the present invention include and light weight high density magnetic material such as NdFeB. Furthermore, the material may be provided as a magnetic element including discrete elements such as discs or a film applied to the moving portion of the piezoelectric speaker. However, the magnetic material should not interfere with the operation of the piezoelectric speaker. Accordingly, flexible, smaller, and lighter materials are preferred.

Figure 3A:
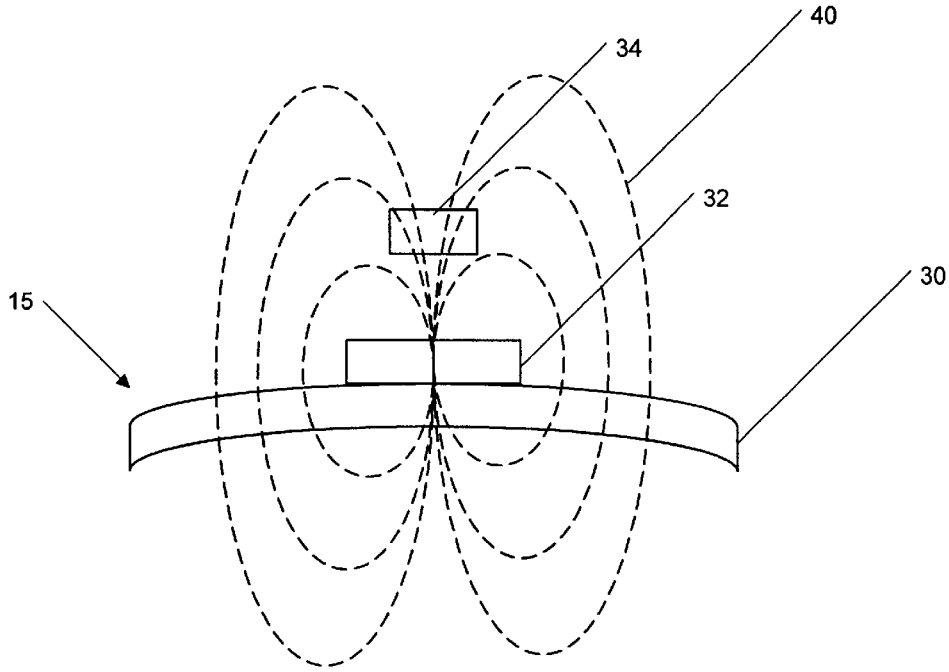
FIG. 3A and FIG. 3B are drawings illustrating operation of a piezoelectric speaker according to the present invention.
Figure 3B:
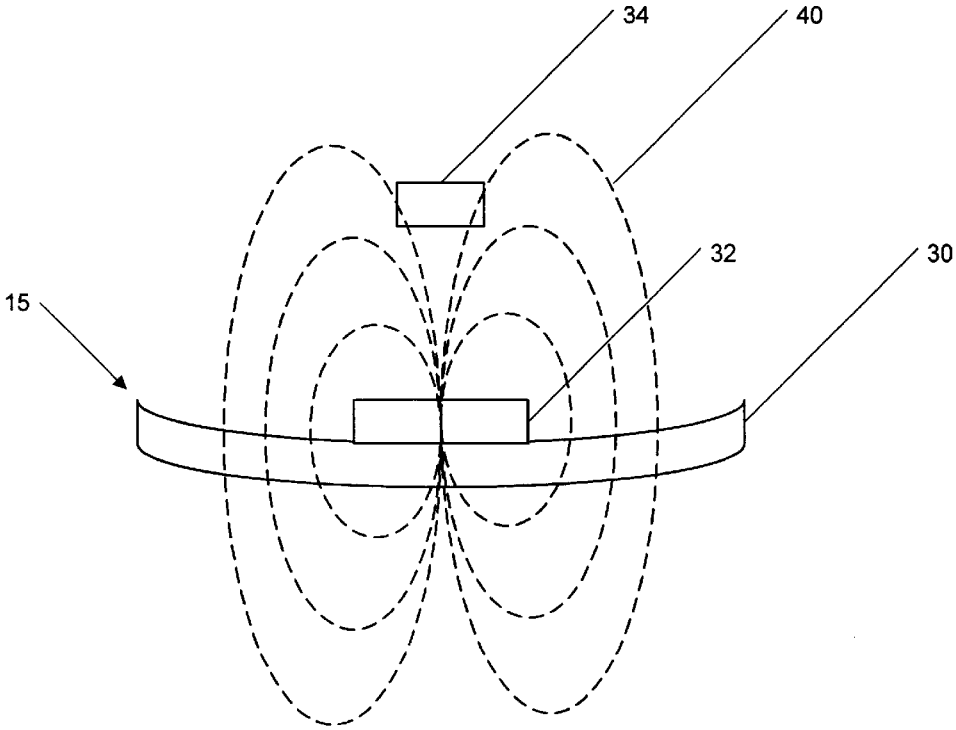

Operation of the present invention will now be described with reference to FIG. 3A and FIG. 3B. As seen in FIG. 3A, when the piezoelectric material 30 is in a first position, a first amount of the magnetic flux from the magnetic material 32, as illustrated by flux lines 40, is coupled to the coil 34 of a hearing aid. As the piezoelectric material 30 moves, as illustrated in FIG. 3B, so does the magnetic material 32. However, the coil 34 remains in approximately the same position. Thus, when the magnetic material 32 moves farther away from the coil 34 fewer of the magnetic flux lines 40 intersect the coil 34, thus indicating that the amount of magnetic flux coupled to the coil 34 has decreased.

As is seen in FIG. 3A and FIG. 3B, as the piezoelectric speaker 15 moves, so does the magnetic material 32 and thus, coil 34 sees a time varying magnetic field which induces a current in coil 34. This current is proportional to the motion of the magnetic material 32 and, therefore, reflects the audio produced by the speaker 15. Accordingly, the inclusion of the magnetic material 32 in piezoelectric speaker 15 allows for use of the piezoelectric speaker with hearing aids. In particular, such a speaker may be utilized in radiotelephones as described above.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A hearing aid compatible acoustic device comprising:

a piezoelectric speaker, wherein a portion of the piezoelectric speaker moves in response to the application of electrical energy to the piezoelectric speaker;

means for generating a time varying magnetic field external to the piezoelectric speaker that is sufficient to drive a hearing aid responsive to the movement of the moving portion of the piezoelectric speaker such that a time varying magnetic field in proportion to audio sounds generated by the piezoelectric speaker is generated when the moving portion of the piezoelectric speaker moves.

2. A hearing aid compatible acoustic device according to claim 1, wherein the means for generating a time varying magnetic field comprises a magnetic element coupled to the moving portion of the piezoelectric speaker so as to move responsive to movement of the moving portion of the piezoelectric speaker.

3. A hearing aid compatible acoustic device comprising:

a piezoelectric speaker, wherein a portion of the piezoelectric speaker moves in response to the application of electrical energy to the piezoelectric speaker and;

means for generating a time varying magnetic field responsive to movement of the moving portion of the piezoelectric speaker such that a time varying magnetic field is generated when the moving portion of the piezoelectric speaker moves comprising a magnetic element coupled to the moving portion of the piezoelectric speaker so as to move responsive to movement of the moving portion of the piezoelectric speaker; and wherein the moving portion of the piezoelectric speaker comprises a diaphragm and the magnetic element is a magnetic film applied to the moving portion of the piezoelectric speaker.

4. A hearing aid compatible acoustic device according to claim 2, wherein the magnetic element is NdFeB.

5. A hearing aid compatible acoustic device according to claim 2, wherein the magnetic element is coupled to a maximum displacement location of the moving portion of the piezoelectric speaker.

6. A hearing aid compatible acoustic device according to claim 1, wherein the hearing aid compatible acoustic device is a speaker in a radiotelephone.

* * * * *